US009019182B2

(12) United States Patent
Jang et al.

(10) Patent No.: US 9,019,182 B2
(45) Date of Patent: Apr. 28, 2015

(54) ORGANIC LIGHT EMITTING DISPLAY AND METHOD OF DRIVING THE SAME ACCORDING TO A DETECTED PATTERN OF AN IMAGE

(75) Inventors: Hwan-Soo Jang, Yongin (KR); Jin-Tae Jeong, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 356 days.

(21) Appl. No.: 13/542,634

(22) Filed: Jul. 5, 2012

(65) Prior Publication Data

US 2013/0208032 A1 Aug. 15, 2013

(30) Foreign Application Priority Data

Feb. 13, 2012 (KR) ..... 10-2012-0014279

(51) Int. Cl.
*G09G 3/32* (2006.01)

(52) U.S. Cl.
CPC ..... *G09G 3/3233* (2013.01); *G09G 2300/0452* (2013.01); *G09G 2310/0262* (2013.01); *G09G 2320/0242* (2013.01); *G09G 2300/0804* (2013.01); *G09G 2300/0861* (2013.01)

(58) Field of Classification Search
CPC ..... G09G 2300/0842; G09G 2320/043; G09G 3/3233
USPC ..... 345/82, 76, 212, 694
See application file for complete search history.

(56) References Cited

U.S. PATENT DOCUMENTS

| | | | | |
|---|---|---|---|---|
| 2004/0070581 | A1* | 4/2004 | Hiraki et al. | 345/209 |
| 2005/0110723 | A1* | 5/2005 | Shin | 345/76 |
| 2006/0022909 | A1 | 2/2006 | Kwak et al. | |
| 2006/0114193 | A1 | 6/2006 | Kwak et al. | |
| 2006/0125807 | A1* | 6/2006 | Park et al. | 345/204 |
| 2006/0279478 | A1* | 12/2006 | Ikegami | 345/30 |
| 2009/0002302 | A1* | 1/2009 | Koo et al. | 345/89 |
| 2011/0102398 | A1 | 5/2011 | Han | |

FOREIGN PATENT DOCUMENTS

| | | |
|---|---|---|
| KR | 10-2006-0010491 | 2/2006 |
| KR | 10-2006-0056791 | 5/2006 |
| KR | 10-2011-0049124 | 5/2011 |

* cited by examiner

*Primary Examiner* — Jonathan Blancha
(74) *Attorney, Agent, or Firm* — Christie, Parker & Hale, LLP

(57) ABSTRACT

An organic light emitting display includes pixel circuits at crossing regions of scan lines, data lines, first emission control lines, and second emission control lines, a pattern detecting unit for detecting a specific pattern of an image to be displayed, an emission control line driver for supplying a first emission control signal to the first emission control lines, and for supplying a second emission control signal to the second emission control lines, and a timing controller for controlling the emission control line driver so that a supply order of the first and second emission control signals corresponds to whether the specific pattern is detected.

15 Claims, 7 Drawing Sheets

ORGANIC LIGHT EMITTING DISPLAY AND METHOD OF DRIVING THE SAME ACCORDING TO A DETECTED PATTERN OF AN IMAGE

CROSS-REFERENCE TO RELATED APPLICATION

This application claims priority to and the benefit of Korean Patent Application No. 10-2012-0014279, filed on Feb. 13, 2012, in the Korean Intellectual Property Office, the entire content of which is incorporated herein by reference.

BACKGROUND

1. Field

Embodiments of the present invention relate to an organic light emitting display and a method of driving the same.

2. Description of the Related Art

Recently, various flat panel displays (FPD) capable of reducing weight and volume, which are disadvantages of cathode ray tubes (CRT), have been developed. The FPDs include liquid crystal displays (LCD), field emission displays (FED), plasma display panels (PDP), and organic light emitting displays.

Among the FPDs, the organic light emitting displays display images using organic light emitting diodes (OLED) that generate light by the re-combination of electrons and holes. The organic light emitting display has high response speed and is driven with low power consumption.

In general, each of the sub pixels of the organic light emitting display includes an OLED and a driver for driving the OLED. The driver controls the amount of current supplied to the OLED so that light of particular (e.g., predetermined) brightness is generated by the sub pixel.

However, when the driver is provided in each of the sub pixels, manufacturing costs increase, and an aperture ratio is reduced. In order to solve the above problem, a method in which one driver drives two OLEDs is suggested.

In order for one driver to drive two OLEDs, one frame is divided into a first field and a second field, and the driver supplies current to a first OLED in a first field and to a second OLED in a second field. To reduce or prevent vertical stripes from being generated, as illustrated in FIG. 1, the sub pixels are driven in the first and second fields in the form of mosaic (e.g., a mosaic-type pattern, or checkered pattern). Different sub pixels emit light in the first field and the second field, and the sub pixels are controlled in the form of mosaic in the first field and the second field.

However, when the sub pixels are controlled in the form of a mosaic, as in a conventional art, a color division phenomenon is generated in a specific pattern, for example, in a 1-dot pattern. In the 1-dot pattern, as illustrated in FIG. 2, light is either emitted or not emitted in units of pixels (each unit including three sub pixels). That is, the 1-dot pattern means a mosaic pattern in which pixels adjacent to a specific pixel (e.g., in the directions up, down, left, and right) do not emit light when the specific pixel emits light.

When the 1-dot pattern is displayed by the panel, red (R) and blue (B) sub pixels emit light in the first field, and green (G) sub pixels emit light in the second field. In this case, the color division phenomenon, which corresponds to the manner in which the colors of the light-emitting sub pixels in the first and second fields are divided, is generated so that picture quality deteriorates.

SUMMARY

Accordingly, embodiments of the present invention provide an organic light emitting display capable of improving picture quality and a method of driving the same.

To achieve the foregoing and/or other aspects of embodiments of the present invention, there is provided an organic light emitting display including pixel circuits at crossing regions of scan lines, data lines, first emission control lines, and second emission control lines, a pattern detecting unit for detecting a specific pattern of an image to be displayed, an emission control line driver for supplying a first emission control signal to the first emission control lines, and for supplying a second emission control signal to the second emission control lines, and a timing controller for controlling the emission control line driver so that a supply order of the first and second emission control signals corresponds to whether the specific pattern is detected.

The specific pattern may correspond to ones of the pixel circuits including red, green, and blue sub pixels that emit light in a checkered pattern.

Each of the pixel circuits may include a driver for controlling current corresponding to a data signal on a data line of the data lines, a first organic light emitting diode (OLED), a second OLED, a first transistor between the first OLED and the driver, and a second transistor between the second OLED and the driver.

An ith first transistor of an ith pixel circuit of the pixel circuits at an ith horizontal line may be coupled to an ith first emission control line of the first emission control lines to be turned off when receiving a first emission control signal, an ith second transistor of the ith pixel circuit may be coupled to an ith second emission control line of the second emission control lines to be turned off when receiving a second emission control signal, an (i+1)th first transistor of an (i+1)th pixel circuit of the pixel circuits at an (i+1)th horizontal line may be coupled to an (i+1)th second emission control line of the second emission control lines to be turned off when receiving the second emission control signal, and an (i+1)th second transistor of the (i+1)th pixel circuit may be coupled to an (i+1)th first emission control line of the first emission control lines to be turned off when receiving the first emission control signal.

When the specific pattern is not detected, the emission control line driver may sequentially supply the second emission control signal to the second emission control lines in a first field period of one frame, and may sequentially supply the first emission control signal to the first emission control lines in a second field period of the one frame excluding the first field period.

When the specific pattern is detected, the emission control line driver may sequentially supply the second emission control signal and the first emission control signal to the ith second emission control line and the (i+1)th first emission control line, respectively, in a first field period of one frame, and may sequentially supply the first emission control signal and the second emission control signal to the ith first emission control line and the (i+1)th second emission control line, respectively, in a second field period of the one frame excluding the first field period.

The first OLED and the second OLED may generate light of different colors, and a pixel of the pixel circuits may include adjacent red, green, and blue OLEDs.

The pattern detecting unit may supply a control signal to the timing controller when the specific pattern is detected.

According to an embodiment of the present invention, there is provided a method of driving an organic light emitting display in which a driver supplies current to a first OLED in a first field period of one frame, and supplies current to a second OLED in a second field period of the one frame, the method including detecting a pattern of an image to be displayed on a panel, and controlling light emitting patterns of sub pixels in the first field period and the second field period when the pattern is detected.

Each of the sub pixels may include an OLED, and a pixel may include adjacent ones of red, green, and blue OLEDs.

The pattern may be a checkered pattern.

When the pattern is not detected, the sub pixels may be controlled to emit light in a checkered pattern.

Ones of the sub pixels that emit light in the first field period may be different from ones of the sub pixels that emit light in the second field period.

When the pattern is detected, the sub pixels may be controlled to emit light in stripes in the first field period and the second field period.

Ones of the sub pixels that emit light in the first field period may be different from ones of the sub pixels that emit light in the second field period.

In the organic light emitting display and the method of driving the same, according to embodiments of the present invention, when the specific pattern, for example, the 1-dot pattern is input, the sub pixels are controlled so that the sub pixels are driven in a stripe-type in the first field and the second field. Then, all of the red, green, and blue sub fields emit light in the first field and the second field so that it is possible to reduce or prevent a color division phenomenon from being generated.

BRIEF DESCRIPTION OF THE DRAWINGS

The accompanying drawings, together with the specification, illustrate exemplary embodiments of the present invention, and, together with the description, serve to explain the aspects of embodiments of the present invention.

DETAILED DESCRIPTION

Figure 1:
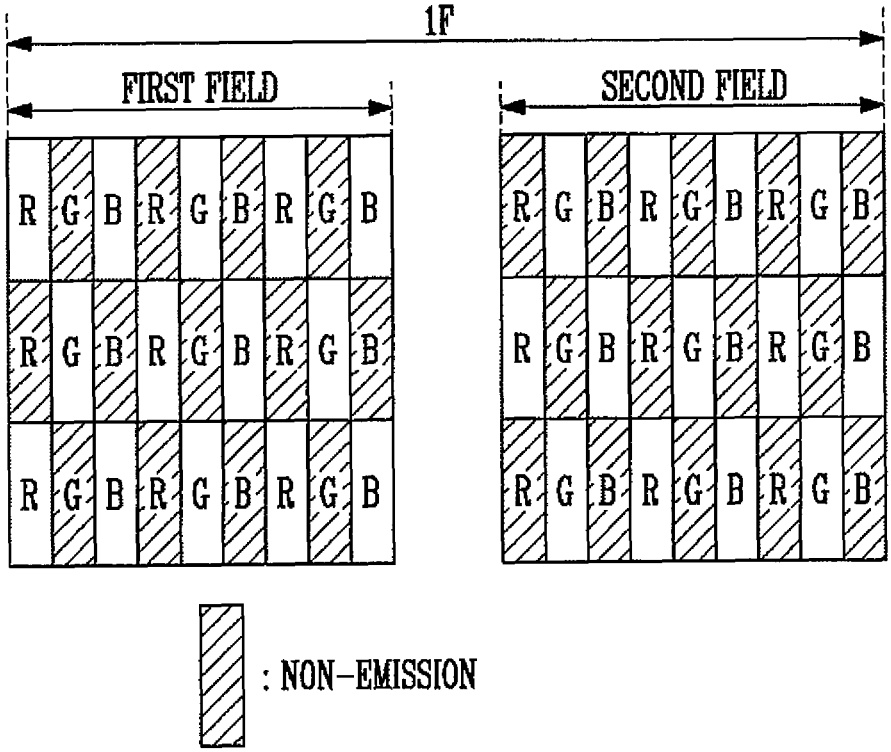
FIG. 1 (PRIOR ART)
FIG. 1 is a view illustrating a method of driving sub pixels that emit light in the form of mosaic in one frame period.
Figure 2:
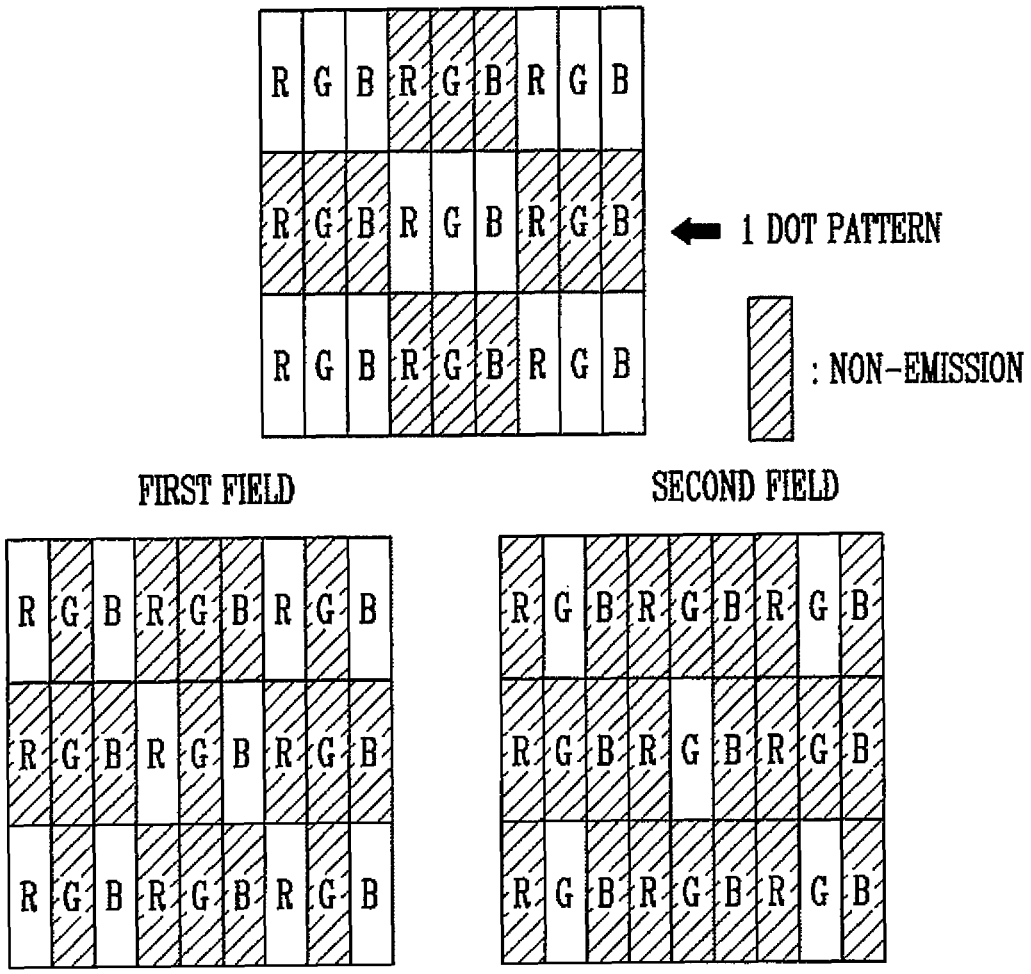
FIG. 2 (PRIOR ART)
FIG. 2 is a view illustrating that a color division phenomenon is generated in a 1-dot pattern.

Hereinafter, certain exemplary embodiments of the present invention will be described with reference to the accompanying drawings. When a first element is described as being coupled to a second element, the first element may be not only directly coupled to the second element, but may also be indirectly coupled to the second element via one or more other elements. Further, some of the elements that are not essential to the complete understanding of the invention are omitted for clarity. Also, like reference numerals refer to like elements throughout.

Hereinafter, an organic light emitting display according to an embodiment of the present invention and a method of driving the same will be described in detail as follows with reference to FIGS. 3 to 9, in which preferred embodiments that those skilled in the art may easily perform are included.

Figure 3:
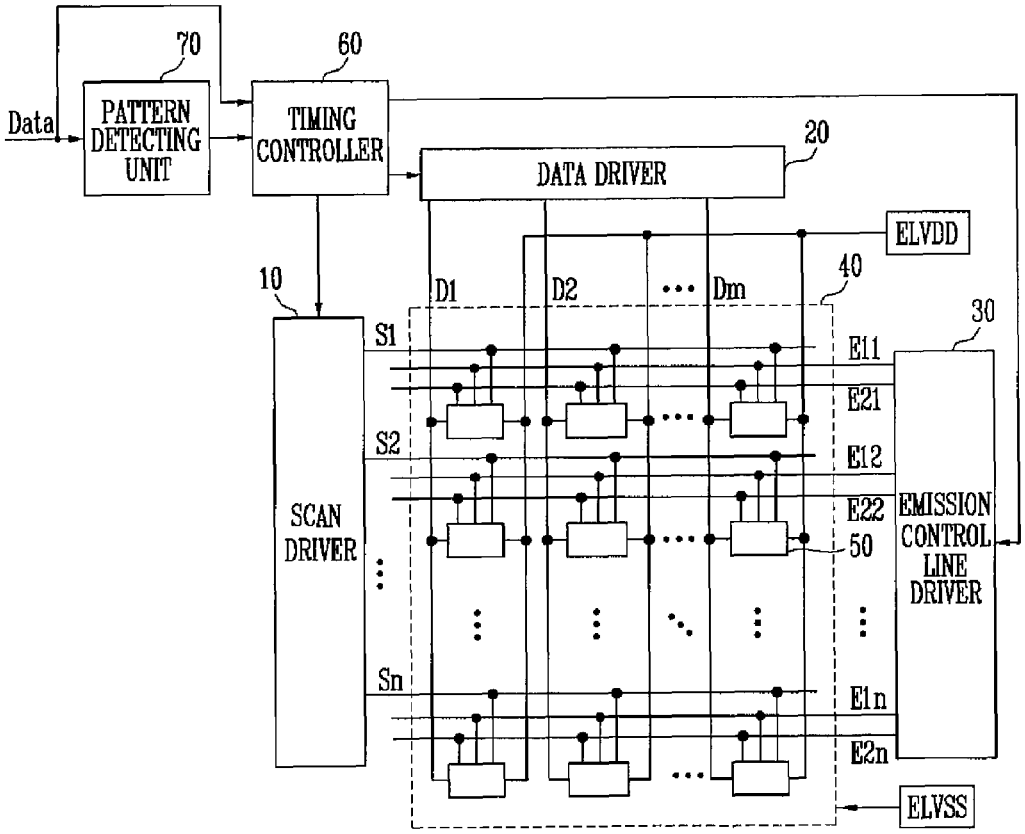
FIG. 3 is a view illustrating an organic light emitting display according to an embodiment of the present invention.

FIG. 3 is a view illustrating an organic light emitting display according to an embodiment of the present invention.

Referring to FIG. 3, the organic light emitting display according to an embodiment of the present invention includes a display unit 40 including pixels 50 positioned at crossing regions of scan lines S1 to Sn, data lines D1 to Dm, first emission control lines E11 to E1*n*, and second emission control lines E21 to E2*n*, a scan driver 10 for driving the scan lines S1 to Sn, a data driver 20 for driving the data lines D1 to Dm, and an emission control line driver 30 for driving the first and second emission control lines E11 to E1*n* and E21 to E2*n*.

In addition, the organic light emitting display according to the present embodiment of the present invention further includes a pattern detecting unit 70 for detecting an image of a specific pattern using data Data and a timing controller 60 for controlling the scan driver 10, the data driver 20, and the emission control line driver 30.

The scan driver 10 sequentially supplies scan signals to scan lines S1 to Sn to correspond to the control of the timing controller 60. When the scan signals are sequentially supplied to the scan lines S1 to Sn, the pixel circuits 50 are selected in units of lines. Therefore, the scan signals are set as voltages by which the transistors included in the pixel circuits 50 may be turned on.

The data driver 20 receives data from the timing controller 60, and generates data signals to correspond to the received data. The data signals generated by the data driver 20 are supplied to data lines D1 to Dm in synchronization with the scan signals.

Each of the pixel circuits 50 includes two sub pixels (that is, two organic light emitting diodes (OLED)), and alternately supplies current to the two sub pixels to generate light (e.g., light of predetermined brightness). The detailed structure of each of the pixel circuits 50 will be described later.

The pattern detecting unit 70 detects whether an image to be displayed by the display unit 40 (or a panel) has a specific pattern (for example, a 1-dot pattern) using data Data input to the pattern detecting unit 70. Here, when the image to be displayed has the 1-dot pattern, a control signal is supplied to the timing controller 60 and the control signal is not supplied in the other cases.

The timing controller 60 controls the scan driver 10 and the data driver 20, and also controls the emission control line driver 30 so that the supply order of the emission control signals may change to correspond to whether the control signal is supplied from the pattern detecting unit 70.

The emission control line driver 30 supplies a first emission control signal to the first emission control lines E11 to E1*n*, and supplies a second emission control signal to the second emission control lines E21 to E2*n*. The emission control line driver 30 controls the order of the emission control signals supplied to the first and second emission control lines E11 to E1*n* and E21 to E2*n* corresponding to the control of the timing controller 60. Detailed description of the above will be performed later.

Figure 4:
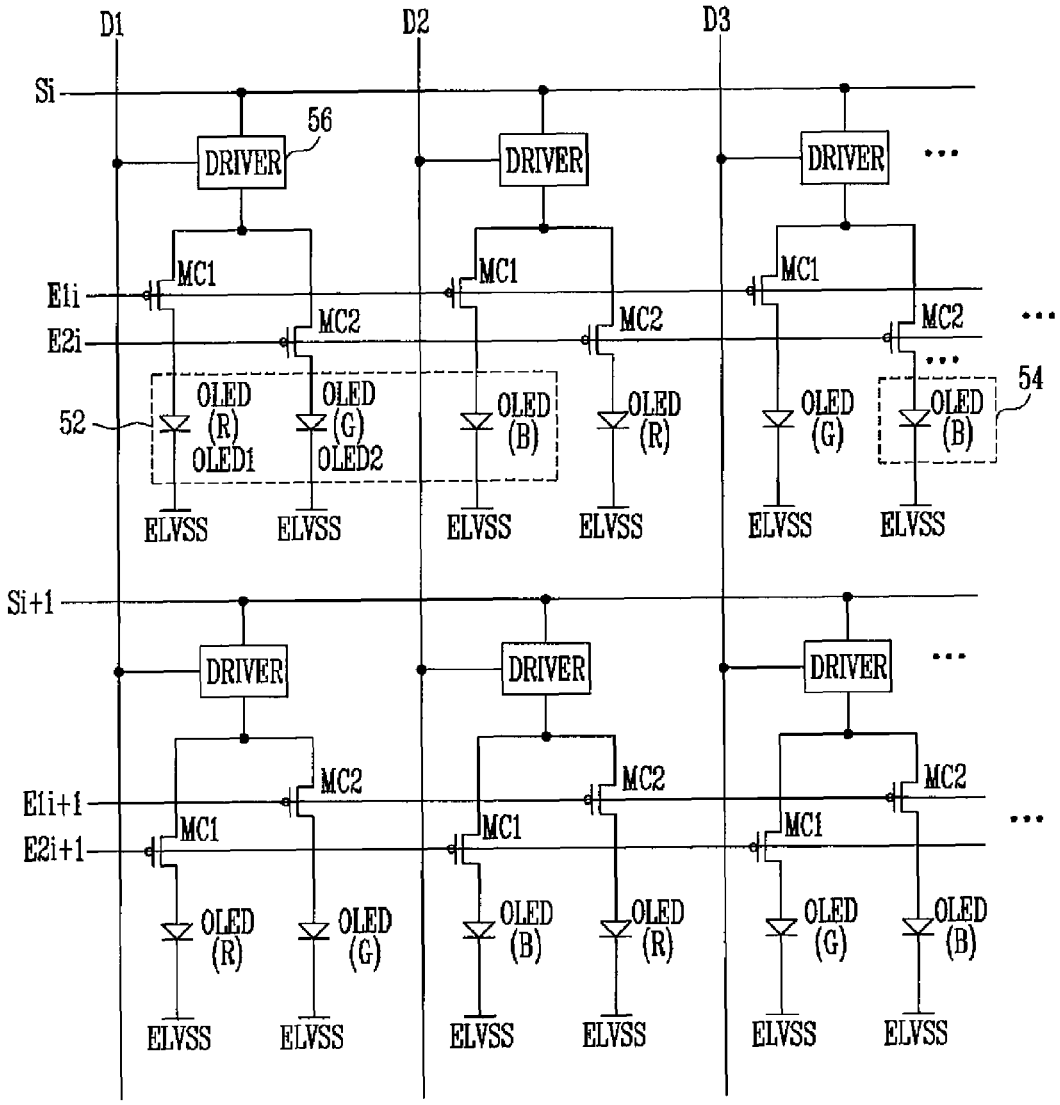
FIG. 4 is a view illustrating an embodiment of the pixel circuits of the embodiment shown in FIG. 3.

FIG. 4 is a view illustrating an embodiment of the pixel circuits of the embodiment shown in FIG. 3. In FIG. 4, pixels circuits positioned in ith and (i+1)th horizontal lines will be illustrated, where "i" is an odd or even number.

Referring to FIG. 4, the pixel circuit 50 according to the present embodiment of the present invention includes a driver 56, a first control transistor MC1, a second control transistor MC2, and two OLEDs. The OLED coupled to the driver 56 and positioned in a first position (left) is referred to a first OLED "OLED1" and the OLED positioned in a second position (right) is referred to a second OLED "OLED2."

The driver 56 is selected when a scan signal is supplied to the scan line Si or Si+1 to which the driver 56 is coupled to receive a data signal from a data line (e.g., D1, D2, or D3). The driver 56 controls the amount of current supplied from a first power source ELVDD (see FIG. 3) to a second power source ELVSS via the first or second OLED OLED 1 or OLED2 to correspond to the data signal.

Here, the driver 56 controls the amount of current to correspond to the first OLED OLED1 in a first field period included in one frame, and controls the amount of current to correspond to the second OLED OLED2 in a second field period, or vice versa. The driver 56 for controlling the amount of current to correspond to the data signal may be realized by various types of circuits.

The first control transistor MC1 is formed between the first OLED OLED1 and the driver 56. The first control transistor MC1 positioned at the ith horizontal line is controlled by a first emission control line E1*i*, and the first control transistor MC1 positioned at the (i+1)th horizontal line is controlled by a second emission control line E2*i*+1.

The second control transistor MC2 is formed between the second OLED OLED2 and the driver 56. The second control transistor MC2 positioned at the ith horizontal line is controlled by a second emission control line E2*i*, and the second control transistor MC2 positioned at the (i+1)th horizontal line is controlled by the first emission control line E1*i*+1.

The first emission control signal supplied to the first emission control lines E11 to E1*n*, and the second emission control signal supplied to the second emission control lines E21 to E2*n*, are set as a voltage by which the control transistors MC1 and MC2 may be turned off.

The first OLED OLED1 and the second OLED OLED2 are coupled to one driver, and emit light (e.g., light of predetermined brightness) in different field periods (e.g., field periods of a frame). The red, green, and blue OLEDs OLED(R), OLED(G), and OLED(B), that is, three sub pixels adjacent to each other, form a pixel 52.

Figure 5:
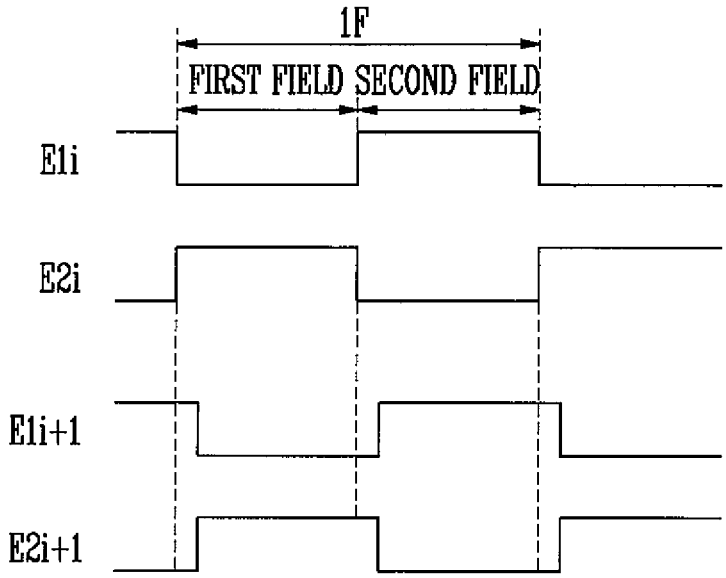
FIG. 5 is a waveform chart illustrating a driving method when a specific pattern is not detected by a pattern detecting unit, according to an embodiment of the present invention.

FIG. 5 is a view illustrating a driving method when a control signal is not supplied from a pattern detecting unit, according to the present embodiment of the present invention.

Referring to FIG. 5, when the control signal is not supplied from the pattern detecting unit 70, the emission control line driver 30 sequentially supplies the second emission control signal to the second emission control lines E21 to E2*n* in the first field period, and sequentially supplies the first emission control signal to the first emission control lines E11 to E1*n* in the second field period, corresponding to the control of the timing controller 60.

Figure 6:
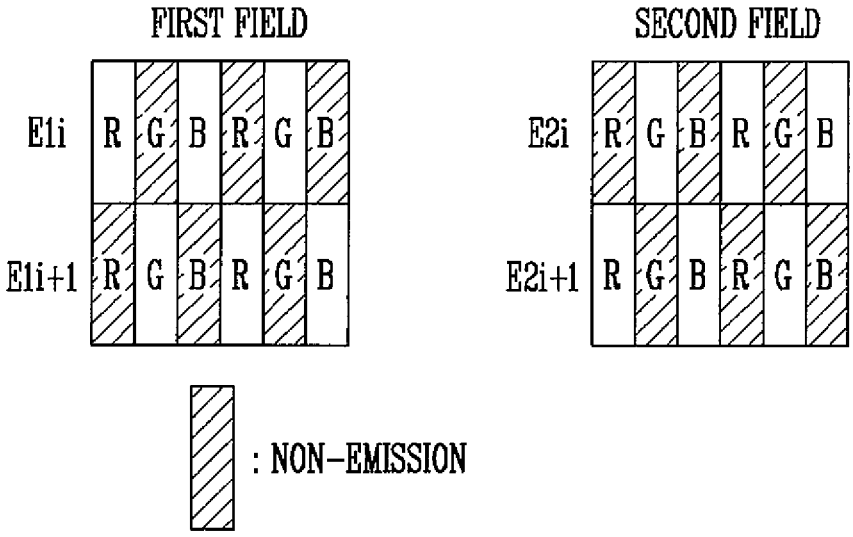
FIG. 6 is a view illustrating sub pixels that emit light to correspond to the driving method of the embodiment illustrated in FIG. 5.

Then, the control transistors MC1 and MC2 coupled to the first emission control lines E11 to E1*n* in the first field period are sequentially turned on in units of lines. That is, in the first field period, the first control transistor MC1 is turned on in the ith horizontal line so that the first OLED OLED1 emits light and the second control transistor MC2 is turned on in the (i+1)th horizontal line so that the second OLED OLED2 emits light. In this case, sub pixels 54 emit light in the form of mosaic, as illustrated in FIG. 6.

In the second field period, the control transistors MC1 and MC2 coupled to the second emission control lines E21 to E2*n* are sequentially turned on in units of lines. That is, in the second field period, the second control transistor MC2 is turned on in the ith horizontal line so that the second OLED OLED2 emits light, and the first control transistor MC1 is turned on in the (i+1)th horizontal line so that the first OLED OLED1 emits light. In this case, the sub pixels 54 that do not emit light in the first field, emit light in the second field period in the form of mosaic.

That is, according to the present embodiment of the present invention, when the control signal is not supplied from the pattern detecting unit 70, that is, when the 1-dot pattern is not input, the display unit 40 emits light in units of sub pixels in the form of a mosaic so that a desired image may be displayed with little or no noise in the form of stripes.

Figure 7:
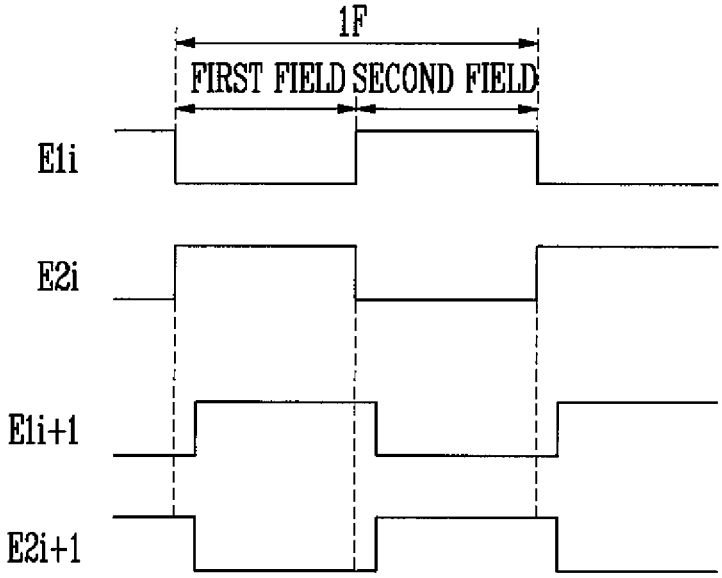
FIG. 7 is a view illustrating a driving method when the specific pattern is detected by the pattern detecting unit, according to an embodiment of the present invention.
Figure 8:
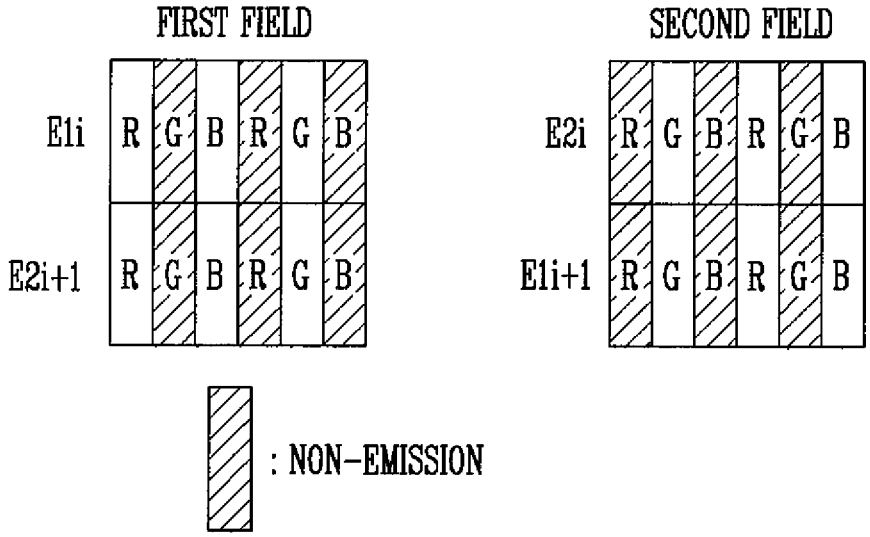
FIG. 8 is a view illustrating sub pixels that emit light to correspond to the driving method of the embodiment illustrated in FIG. 7.

FIG. 7 is a view illustrating a driving method when the control signal is supplied from the pattern detecting unit according to an embodiment of the present invention.

Referring to FIG. 7, when the control signal is supplied from the pattern detecting unit 70, the emission control line driver 30 sequentially supplies the first emission control signal and the second emission control signal corresponding to the control of the timing controller 60. The first emission control signal and the second emission control signal are alternately supplied based on a horizontal line.

That is, the emission control line driver 30 supplies the second emission control signal to the ith second emission control line E2*i*, and supplies the first emission control signal to the (i+1)th first emission control line E1*i*+1, in the first field period.

Then, in the first field period, the first control transistors MC1 are turned on so that the first OLEDs OLED1 emit light in the form of stripes, as illustrated in FIG. 7.

In the second field period, the emission control line driver 30 supplies the first emission control signal to the ith first emission control line E1*i*, and supplies the second emission control signal to the (i+1)th second emission control line E2*i*+1 Then, in the second field period, the second control transistors MC2 are turned on so that the second OLEDs OLED2 emit light in the form of stripes.

That is, according to the present embodiment of the present invention, when the control signal is supplied from the pattern detecting unit 70, that is, when the 1-dot pattern is displayed on the display unit 40, the sub pixels are controlled to emit light in the form of stripes. When different sub pixels emit light in the form of stripes in the first and second fields, although the 1-dot pattern is input, a color division phenomenon is not generated.

Figure 9:
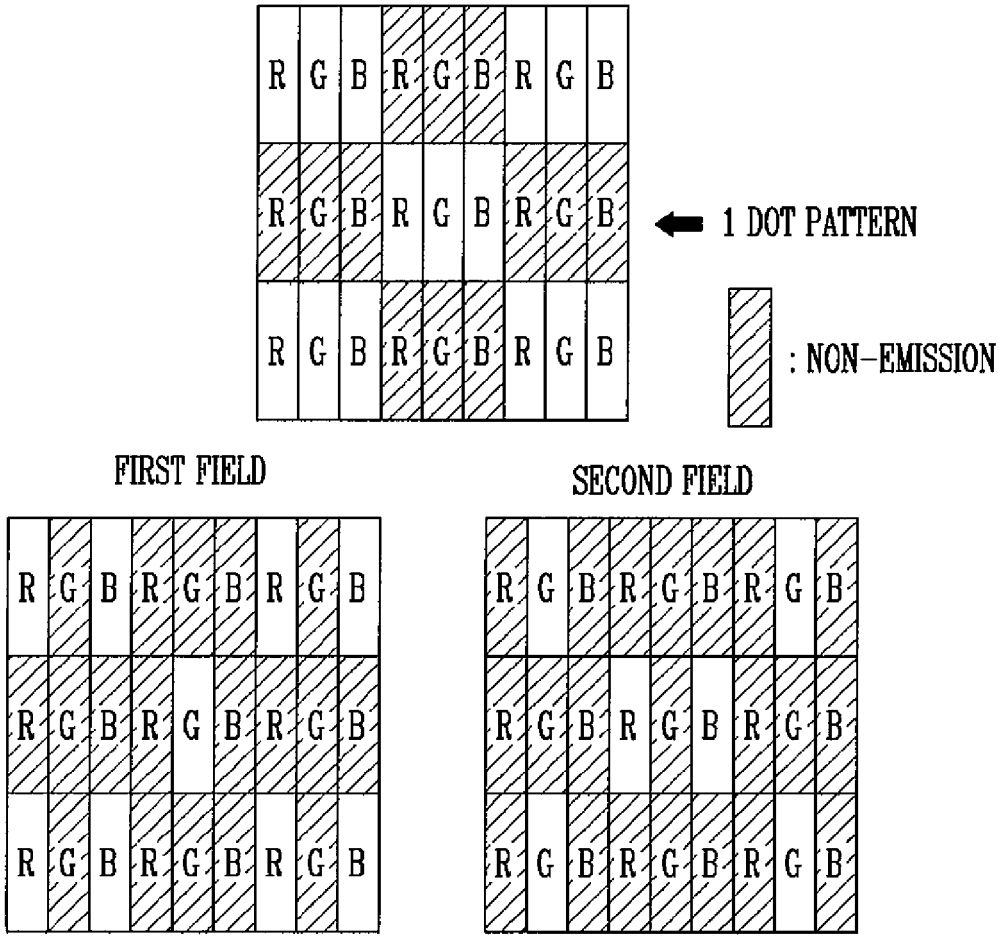
FIG. 9 is a view illustrating sub pixels that emit light to correspond to a 1-dot pattern when the sub pixels are driven by the driving method of the embodiment illustrated in FIG. 7.

Actually, when the 1-dot pattern is input, as illustrated in FIG. 9, the red (R), blue (B), and green (G) sub pixels emit light in the first field and the second field so that the image of the 1-dot pattern may be displayed without the color division phenomenon.

While embodiments of the present invention have been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display, comprising:

pixel circuits at crossing regions of scan lines, data lines, first emission control lines, and second emission control lines;

a pattern detecting unit for detecting a specific pattern of an image to be displayed;

an emission control line driver for supplying a first emission control signal to the first emission control lines, and for supplying a second emission control signal to the second emission control lines; and a timing controller for controlling the emission control line driver so that a supply order of the first and second emission control signals corresponds to whether the specific pattern is detected, wherein the specific pattern includes a checkered pattern.

2. The organic light emitting display as claimed in claim 1, wherein the specific pattern corresponds to ones of the pixel circuits comprising red, green, and blue sub pixels that emit light in a checkered pattern.

3. The organic light emitting display as claimed in claim 1, wherein each of the pixel circuits comprises:

a driver for controlling current corresponding to a data signal on a data line of the data lines;

a first organic light emitting diode (OLED);

a second OLED;

a first transistor between the first OLED and the driver; and a second transistor between the second OLED and the driver.

4. The organic light emitting display as claimed in claim 3, wherein an ith first transistor of an ith pixel circuit of the pixel circuits at an ith horizontal line is coupled to an ith first emission control line of the first emission control lines to be turned off when receiving a first emission control signal, wherein an ith second transistor of the ith pixel circuit is coupled to an ith second emission control line of the second emission control lines to be turned off when receiving a second emission control signal, wherein an (i+1)th first transistor of an (i+1)th pixel circuit of the pixel circuits at an (i+1)th horizontal line is coupled to an (i+1)th second emission control line of the second emission control lines to be turned off when receiving the second emission control signal, and wherein an (i+l)th second transistor of the (i+l)th pixel circuit is coupled to an (i+1)th first emission control line of the first emission control lines to be turned off when receiving the first emission control signal.

5. The organic light emitting display as claimed in claim 4, wherein, when the specific pattern is not detected, the emission control line driver sequentially supplies the second emission control signal to the second emission control lines in a first field period of one frame, and sequentially supplies the first emission control signal to the first emission control lines in a second field period of the one frame excluding the first field period.

6. The organic light emitting display as claimed in claim 4, wherein, when the specific pattern is detected, the emission control line driver sequentially supplies the second emission control signal and the first emission control signal to the ith second emission control line and the (i+1)th first emission control line, respectively, in a first field period of one frame, and sequentially supplies the first emission control signal and the second emission control signal to the ith first emission control line and the (i+1)th second emission control line, respectively, in a second field period of the one frame excluding the first field period.

7. The organic light emitting display as claimed in claim 3, wherein the first OLED and the second OLED generate light of different colors, and wherein a pixel of the pixel circuits comprises adjacent red, green, and blue OLEDs.

8. The organic light emitting display as claimed in claim 1, wherein the pattern detecting unit supplies a control signal to the timing controller when the specific pattern is detected.

9. A method of driving an organic light emitting display in which a driver supplies current to a first OLED in a first field period of one frame, and supplies current to a second OLED in a second field period of the one frame, the method comprising:

detecting a pattern of an image to be displayed on a panel; and controlling a supply order of first and second emission control signals respectively supplied to first and second emission control lines corresponding to light emitting patterns of sub pixels in the first field period and the second field period when the pattern is detected, wherein the pattern includes a checkered pattern.

10. The method as claimed in claim 9, wherein each of the sub pixels comprises an OLED, and wherein a pixel comprises adjacent ones of red, green, and blue OLEDs.

11. The method as claimed in claim 10, wherein the pattern is a checkered pattern.

12. The method as claimed in claim 9, wherein, when the pattern is not detected, the sub pixels are controlled to emit light in a checkered pattern.

13. The method as claimed in claim 12, wherein ones of the sub pixels that emit light in the first field period are different from ones of the sub pixels that emit light in the second field period.

14. The method as claimed in claim 9, wherein, when the pattern is detected, the sub pixels are controlled to emit light in stripes in the first field period and the second field period.

15. The method as claimed in claim 14, wherein ones of the sub pixels that emit light in the first field period are different from ones of the sub pixels that emit light in the second field period.

* * * * *